US005653388A

United States Patent [19]

Pietschmann et al.

[11] Patent Number: 5,653,388

[45] Date of Patent: Aug. 5, 1997

[54] METHOD AND APPARATUS FOR CONSTRUCTING A PERMANENT RAILROAD TRACK

[75] Inventors: Dieter Pietschmann, Naumburg; Hans Bachmann, Neumarkt, both of Germany; Pierre-Olivier Boutin, Louveciennes, France; Winfried Mohr, Neumarkt, Germany; Gilles de Pontbriand, Mantes La Jolie, France; Franz Geissler, Velburg, Germany

[73] Assignee: Pfleiderer Verkehrstechnik GmbH & Co. KG, Neumarkt, Germany

[21] Appl. No.: 610,684

[22] Filed: Mar. 4, 1996

[30] Foreign Application Priority Data

Mar. 8, 1995 [DE] Germany ..... 195 08 107.2

[51] Int. Cl.[6] ..... E01B 1/00

[52] U.S. Cl. ..... 238/7

[58] Field of Search ..... 238/2, 6, 7, 8, 238/9

[56] References Cited

U.S. PATENT DOCUMENTS

| | | | |
|---|---|---|---|
| 1,350,760 | 8/1920 | Wilson | 238/7 |
| 2,672,295 | 3/1954 | Cone | 238/9 |
| 4,232,822 | 11/1980 | Hahn et al. | 238/7 |
| 4,616,395 | 10/1986 | Farese et al. | 238/7 |
| 5,285,964 | 2/1994 | Vanotti | 238/9 |
| 5,464,152 | 11/1995 | Wabnitz | 238/8 |
| 5,503,082 | 4/1996 | Bosma | 238/9 |

*Primary Examiner*—S. Joseph Morano
*Attorney, Agent, or Firm*—Jordan and Hamburg

[57] ABSTRACT

A method for installing a permanent railroad track, for which the concrete railroad ties, carrying the tracks, are lined up positionally in a concrete trough and embedded in a casting compound with embedment in longitudinal reinforcements, in that, to begin with, the tracks with the railroad ties are pre-assembled into a track lattice, which is lined up with the upper edge of the rails and subsequently cast, 2-block concrete railroad ties with two reinforced individual blocks being used, the reinforcement comprising essentially structural steel rods, which run essentially parallel to the axis of the railroad ties, are connected by axially spaced-apart shackles into a reinforcing cage and extend continuously as connecting rods through both individual blocks, at least some protruding beyond the outer end surfaces of the individual blocks and the longitudinal reinforcements, which were previously placed loosely in the concrete trough, being raised and connected with the connecting rods and with the ends of the structural steel rods protruding on the outside, as well as a track-regulating gantry for implementing the installation method.

10 Claims, 3 Drawing Sheets

METHOD AND APPARATUS FOR CONSTRUCTING A PERMANENT RAILROAD TRACK

BACKGROUND OF THE INVENTION

The invention relates to a method for installing a permanent railroad track, for which the concrete railroad ties, carrying the tracks, are lined up positionally in a concrete trough and embedded in a casting compound, particularly in concrete, with embedment in longitudinal reinforcements.

In the case of this method of installation, which has become known as the so-called "Rheda Method", the railroad ties are individually lined up to begin with and the longitudinal reinforcement is subsequently inserted through transverse holes in the concrete railroad ties.

Aside from the awkward, individual adjustment of the railroad ties, this method suffers from the disadvantage that the introduction of the longitudinal reinforcement into transverse holes in concrete railroad ties, which holes have to be provided additionally, is laborious.

SUMMARY OF THE INVENTION

It is therefore an object of the invention to develop the installation method of the initially-mentioned type further so that the railroad ties and rails can be laid more simply and more precisely.

Pursuant to the invention, this objective is accomplished in that the tracks and the railroad ties, to begin with, are pre-assembled into a track lattice, the upper surface of the rails is lined up by means of a large number of track-regulating gantries fastened to the concrete trough and the tracks are cast in.

The decisive advantage lies in the use of the track-regulating gantries. At intervals of, in each case, 2 to 4 and preferably 3 railroad ties, a complete track lattice can be pre-adjusted relatively easily in lengths up to 80 or possibly even 160 meters. Subsequently, the fine adjustment is accomplished by optically leveling to the upper edge of the rails with actuation of the adjusting devices of the track-regulating gantries.

The inventive installation method is rendered particularly advantageous due to the use of 2-block concrete railroad ties with two reinforced individual blocks, the reinforcement comprising structural steel rods, which run essentially parallel to the axis of the railroad ties, are connected by shackles, which are axially spaced apart, into a reinforcing cage. The structural steel rods extend continuously through the two individual blocks. At least some of the rods protrude beyond the outer end surfaces of the individual blocks. The longitudinal reinforcement, which previously had been inserted loosely in the concrete trough, is raised and connected with the connecting rods and the ends of the structural rods protruding on the outside. As a result of these special 2-block concrete railroad ties, it is no longer necessary to introduce the transverse holes in the railroad tie concrete and, in particular, to thread the longitudinal reinforcement laboriously, which obviously could not be done meaningfully at all since, pursuant to the invention, whole track lattices are laid. The inventive method merely requires that the longitudinal reinforcement be raised from below. The reinforcement is connected to the connecting rods in the center between the individual blocks, preferably from below, and they can be raised on the outside over the protruding ends of the structural steel rods and set down and fastened at the top. This can obviously be accomplished very easily in sections by successively raising the longitudinal reinforcement and thus makes it very much easier to connect the concrete railroad ties to the longitudinal reinforcement before the concrete trough is lined preferably with concrete.

The concrete trough can be assembled either from in situ concrete or prefabricated parts on a foundation, such as a concrete slab, or also produced by means of a slip form paver.

Finally, it is also within the scope of the invention to lay the concrete trough directly on elastomeric material as insulation against structure-borne noise.

Further advantages, distinguishing features and details of the invention arise out of the following description of an example and from the accompanying drawings.

DESCRIPTION OF THE PREFERRED EMBODIMENTS

Figure 1:
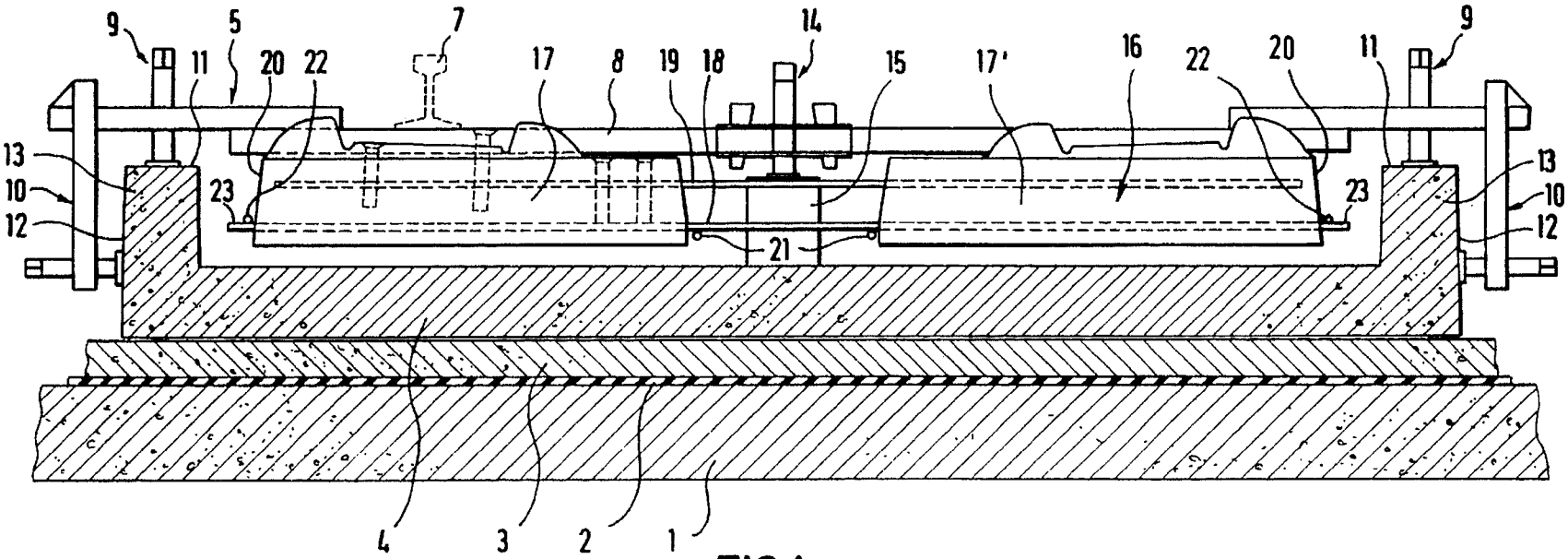
FIG. 1 is a section through a concrete trough, on which the track-regulating gantry is placed for lining up a 2-block concrete railroad tie, which is used preferably pursuant to the invention.

In the embodiment represented, which shows the installation method for forming a solid railroad track, particularly for a railroad on a free route or a metropolitan railroad or a railroad in tunnels or on bridges, a concrete trough 4, in which the railroad ties are to be held by casting, is disposed on a concrete slab 1 with interpositioning of a seal 2 and a protective layer 3 of concrete. For this purpose, track-regulating gantries 5 are placed upon the concrete trough 4 at intervals preferably of three railroad ties in each case. These track-regulating gantries 5 comprise cross girders 8, which engage the rails 7 from below in each case between two railroad ties and in turn are held, so that they can be shifted transversely and in height, on bearing blocks 9 and 10, which engage partially the upper sides 11 and partially the outer surfaces 12 of the walls 13 of the concrete trough. In the example shown, the track-regulating gantries additional have an intermediate beating block 14, which supports the cross member 8 additionally in the center. This intermediate beating block 14 is supported on an installation block 15, which is inserted in the concrete trough in each case between two railroad ties and later on, after the tracks are lined up, also cast. The intermediate bearing block 14 is operable to adjust the height of the cross girders 8.

Pursuant to the invention, the installation is accomplished owing to the fact that, to begin with, the railroad ties with the rails 7 are pre-assembled into a relatively long track lattice and a whole track lattice is then adjusted for the upper edge of the rail and cast in the concrete trough.

Of particular importance for the inventive installation method is the use of the concrete railroad ties 16, which are shown in the drawing and constructed as 2-block concrete railroad ties with two individual blocks 17 and 17', which are connected to one another by continuous parts of structural steel rods 18 and 19 forming the reinforcing cages. In this connection, preferably three spaced-apart structural steel rods 18', 18", 18'" are provided in the lower plane and two spaced-apart structural steel rods 19', 19" above these in the upper plane. The structural steel rods are connected by shackles 6 into the reinforcing cages within the individual blocks 17, 17'. Preferably, the lower structural steel rods 18 are extended to such an extent, that they protrude to the outside beyond the outer end surfaces 20 of the individual blocks.

This special construction of the 2-block concrete railroad ties enables the railroad ties to be connected very simply with longitudinal reinforcements 21 and 22, which additionally are to hold the railroad ties in the casting compound (not shown) in the concrete trough. These longitudinal reinforcements 21 and 22 can namely simply be placed in the concrete trough 4 and, after a track lattice is lined up, raised sectionally precisely to the upper edge of the rails with the help of the track-regulating gantry 5 and connected with the reinforcement rods 18 lying exposed between the individual blocks 17, 17' as connecting rods, while the outer, longitudinal reinforcements 22 are raised from the bottom of the concrete trough and placed on the protruding ends 23 of the structural steel rods 18 and, in turn, connected with these ends. The laborious threading of the longitudinal reinforcements 21, 22 through the transverse holes of the concrete railroad ties, which cannot be done at all any more when longer sections are installed, is thus omitted.

Figure 2:
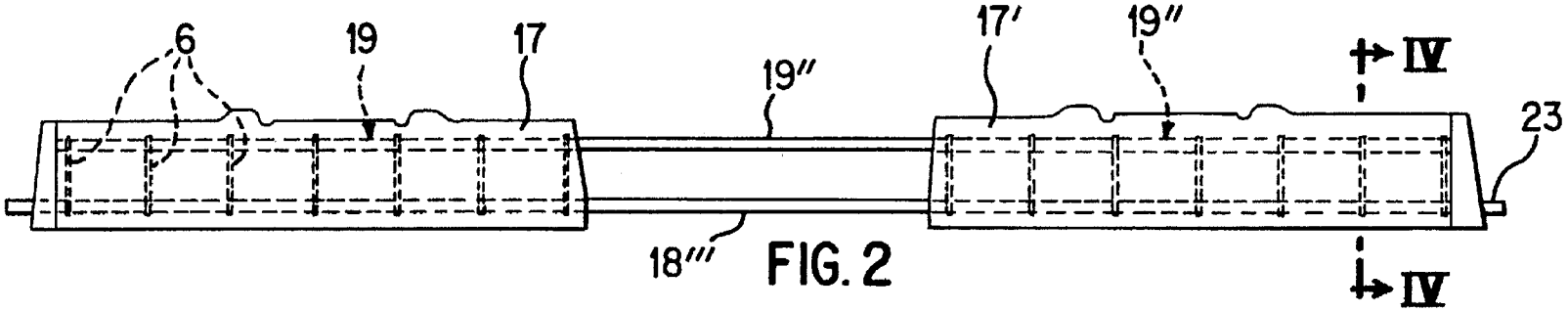
FIG. 2 is an elevational view of a 2-block concrete railroad tie according to the invention.
Figure 3:
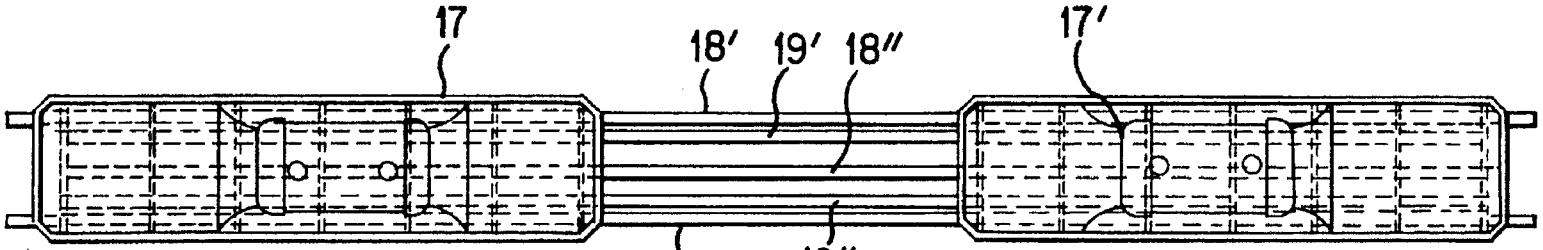
FIG. 3 is a plan view of the railroad tie shown in FIG. 2.
Figure 4:
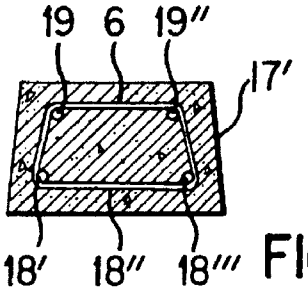
FIG. 4 is a sectional view taken along the line IV—IV in FIG. 2.

FIG. 2 shows the spaced shackles 6 which may be bent metal members formed as shown in FIG. 4 and connected to the steel rods 18, 19, preferably by a wire connector although a welding connector or a clamp connection may be used.

The steel rods 18, 19 and the longitudinal reinforcements 21, 22 are preferably connected by wire connections although a welding connector or a clamp connection may be used.

The bearing blocks 9, 10 and 14 use threaded members to provide the adjustment. Alternatively, fluid-operated cylinder may be used.

Figure 5:
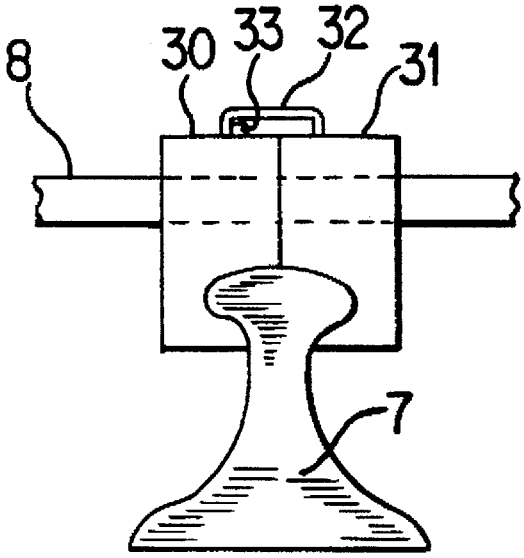
FIG. 5 is a partial schematic view of an alternate embodiment where the rails are gripped and suspended.

FIG. 5 shows an alternate embodiment wherein the rail 7 is suspended from the cross girder 8 by a gripper means which grips the rail 7. The gripper means may comprise two gripper blocks 30, 31 in which one gripper block 31 can slide on the cross girder 8 from a position gripping the rail 7 in cooperation with the other grip block 30 as shown in FIG. 5 to a release position wherein the gripper block 31 is spaced from the gripper block 30 to thereby release the rail 7 from the gripper means. A pivotal latch 32 and catch 33 may be provided to latch the gripper blocks 30, 31 in the gripping position shown in FIG. 5.

The invention is not limited to the example shown. Aside from the possibility of using track-regulating gantries of a different construction, it would, for example, also be possible to provide a layer of elastomeric material as insulation against structure-borne noise between the concrete trough 4 and its foundation.

What we claimed is:

1. A method for installing a permanent railroad track comprising:

providing a plurality of concrete railroad ties each comprising two spaced blocks of concrete spaced from one another along a longitudinal axis;

utilizing metal rods to reinforce each railroad tie with said steel rods extending longitudinally and continuously through the two spaced blocks of concrete of each tie and continuously through the space between the two spaced blocks of each tie;

providing at least some of said rods with longitudinal end portions which extend beyond the outer longitudinal ends of each of the two spaced blocks of each tie;

forming a concrete trough;

disposing elongated metal reinforcement members in said trough;

pre-assembling a plurality of said ties and tracks into a pre-assembled lattice and disposing said pre-assembled lattice in said trough;

aligning said pre-assembled lattice in said trough;

connecting said elongated metal reenforcement members to said longitudinal end portions of said steel rods; and introducing a casting compound into said trough to thereby embed said ties in said casting compound.

2. A method according to claim 1 wherein said aligning step comprises utilizing a plurality of adjustable track-regulating gantries mounted on said trough for adjusting the position of said pre-assembled lattice relative to said trough.

3. A method according to claim 2 further comprising removing said plurality of adjustable track-regulating gantries from said trough after said casting compound has been introduced into said trough.

4. A method according to claim 2 further comprising disposing said adjustable track-regulating gantries between two juxtaposed and spaced ties at intervals of every two to four ties.

5. A method according to claim 4 further comprising disposing said adjustable track-regulating gantries at intervals of every three ties.

6. A method according to claim 1 wherein said aligning step comprises providing an adjustable support for adjustably supporting said pre-assembled lattice on said trough, and adjusting the position of said pre-assembled lattice in said trough utilizing said adjustable support.

7. A method according to claim 6 further comprising providing said adjustable support with a transverse support member, supporting said tracks with said transverse support member, and supporting an intermediate part of said transverse support member utilizing an installation block disposed in said trough.

8. A method according to claim 1 wherein said trough has generally vertically disposed outer walls with each outer wall having a top surface and an outer surface generally perpendicular to said top surface, said aligning step comprising adjusting the vertical height of said tracks relative to said top surface of said trough and adjusting the horizontal position of said tracks relative to said outer surface of said trough.

9. A method according to claim 1 further comprising connecting said elongated metal reinforcement members to the sections of the rods which extend between the spaced blocks of each tie.

10. A method for installing a railroad track comprising:

providing a plurality of railroad ties each comprising two spaced blocks spaced from one another along a longitudinal axis;

utilizing rods to reinforce each railroad tie with said rods extending longitudinally and continuously through the two spaced blocks of each tie and continuously through the space between the two spaced blocks of each tie;

providing at least some of said rods with longitudinal end portions which extend beyond the outer longitudinal ends of each of the two spaced blocks of each tie;

disposing elongated reinforcement members in a trough;

pre-assembling a plurality of said ties and tracks into a pre-assembled lattice and disposing said pre-assembled lattice in said trough;

connecting said elongated reenforcement members to said longitudinal end portions of said rods; and introducing a casting compound into said trough to thereby embed said ties in said casting compound.

* * * * *